US006789529B2

(12) United States Patent
Suzuki et al.

(10) Patent No.: US 6,789,529 B2
(45) Date of Patent: Sep. 14, 2004

(54) PULSATION DAMPING DEVICE IN FUEL PUMP MODULE

(75) Inventors: Masakazu Suzuki, Sashima-gun (JP); Yasuhiro Hosoya, Sashima-gun (JP); Hironobu Oki, Sashima-gun (JP)

(73) Assignee: Kyosan Denki Co. Ltd., Ibaraki (JP)

( * ) Notice: Subject to any disclaimer, the term of this patent is extended or adjusted under 35 U.S.C. 154(b) by 22 days.

(21) Appl. No.: 10/293,562

(22) Filed: Nov. 14, 2002

(65) Prior Publication Data

US 2003/0094161 A1 May 22, 2003

(30) Foreign Application Priority Data

Nov. 20, 2001 (JP) ..... 2001-354815

(51) Int. Cl.[7] ..... F02M 37/04
(52) U.S. Cl. ..... 123/509; 123/457
(58) Field of Search ..... 123/509, 510, 123/511, 512, 457; 417/312, 313

(56) References Cited

U.S. PATENT DOCUMENTS 4,264,287 A 4/1981 Ishida et al.
5,718,208 A * 2/1998 Brautigan et al. ..... 123/516
5,785,032 A * 7/1998 Yamashita et al. ..... 123/509
6,123,521 A * 9/2000 Mori et al. ..... 417/423.3
6,129,074 A 10/2000 Frank
6,260,543 B1 * 7/2001 Chih ..... 123/509
6,308,691 B1 * 10/2001 Frank et al. ..... 123/509

FOREIGN PATENT DOCUMENTS

EP 0 754 483 A1 1/1997
EP 0 922 850 A2 6/1999
JP A 2001-270336 10/2001

* cited by examiner

*Primary Examiner*—Mahmoud Gimie
(74) *Attorney, Agent, or Firm*—Oliff & Berridge, PLC

(57) ABSTRACT

A fuel pump module is provided with a fuel pump for sucking and discharging a fuel in a fuel tank, a fuel filter downstream of the fuel pump for removing a foreign matter in the fuel, and a fuel pressure control valve for adjusting discharge of the fuel that flowed out from the fuel filter to a combustion chamber. Furthermore, fuel pulsation damping means (a damping portion) is formed between the fuel filter and a flow-out chamber formed below a filter element in the fuel filter and/or a fuel pressure control valve which is an adjacent portion to the flow-out chamber.

10 Claims, 10 Drawing Sheets

PULSATION DAMPING DEVICE IN FUEL PUMP MODULE

INCORPORATION BY REFERENCE

The disclosure of Japanese Patent Application No. 2001-354815 filed on Nov. 20, 2001 including the specification, drawings and abstract is incorporated herein by reference in its entirety.

BACKGROUND OF THE INVENTION

1. Field of the Invention

The invention relates to a pulsation damping device in a fuel pump module in a fuel tank, in particular, the pulsation damping devise which prohibits generation of an abnormal noise such as a valve hit noise caused by a fuel pressure control valve due to pulsation of a fuel discharged from the fuel tank.

2. Description of Related Art

A fuel in a fuel supply system is discharged from a fuel tank by a delivery force of a fuel pump of a pump module disposed in the fuel tank (hereinafter referred to as a fuel pump). Next, the fuel is filtered by a fuel filter and injected through a fuel injector toward a combustion chamber of an internal combustion engine. Further, a fuel pressure control valve is disposed downstream of the fuel filter for the purpose of adjusting a pressure of the aforementioned injected fuel.

In the aforementioned fuel supply system, the fuel pump and the fuel filter and the like are installed in the fuel tank for the purpose of simplifying the structure and reducing an effect of the heat.

FIG. 9 is a vertical sectional view showing a fuel pump module A which is a related art of the invention, and FIG. 10 is a horizontal sectional view of the same.

Hereinafter a structure of the fuel pump module will be explained. The fuel pump module A is provided with a fuel pump B, a fuel filter C downstream of the fuel pump B, a flow-out chamber D in the fuel filter C, and a discharge pipe E continuously formed with the flow-out chamber D.

Moreover, a fuel pressure control valve F is attached to an adjacent portion to the flow-out chamber D in order to adjust a pressure of a fuel supplied from the discharge pipe E to an engine combustion chamber to a predetermined value.

The fuel pump module A with the aforementioned structure applies the fuel with pulsation by means of rotation of a motor in the fuel pump B, which is a driving source. Next, the fuel applied with pulsation is discharged, as it is, to the combustion chamber through the discharge pipe E.

Moreover, the pulsation is amplified by passing of the fuel in a filter element G of the fuel filter C. Further, when the fuel containing the aforementioned pulsation component is transmitted to the fuel pressure control valve F, the fuel pressure control valve F acts as a resonate body so as to further amplify the pulsation. This sometimes causes generation of an abnormal noise such as a valve hit noise from the fuel pressure control valve F.

SUMMARY OF THE INVENTION

It is therefore an object of the invention to provide a pulsation damping device in a fuel pump module that inhibits generation of an abnormal noise such as a valve hit noise, by forming pulsation damping means in a transmission passage of a fuel between a fuel pump and a fuel pressure control valve.

In order to accomplish the aforementioned object, a pulsation damping device according to an aspect of the invention is provided with a fuel pump for sucking and discharging a fuel in a fuel tank, a fuel filter downstream of the fuel pump for removing a foreign matter in the fuel, and a fuel pressure control valve for adjusting discharge of the fuel that flowed out from the fuel filter to the combustion chamber. Furthermore, a damping portion for damping pulsation of the fuel is provided between the fuel filter and the fuel pressure control valve. In particular, the damping portion is provided between a flow-out chamber formed at downstream of a filter element in the fuel pump and a fuel pressure control valve which is an adjacent portion to the flow-out chamber.

The damping portion may be a buffer wall formed in a supply conduit continuously formed with the flow-out chamber via a communication hole in a side wall of a filter case so as to form a branch passage to a supply pipe to an engine combustion chamber and to the fuel pressure control valve.

Further, the damping portion may be a conduit disposed in the flow-out chamber. One end portion of the conduit is opened in the flow-out chamber, and other end portion thereof is opened in the supply conduit continuously formed via a communication hole in the side wall of the filter case.

Moreover, the aforementioned damping portion may be a fuel passage formed in the flow-out chamber. The flow passage is a fuel flow passage formed by a first circular separation wall, having a notch portion at a part thereof, for dividing a substantially circular space, and a second separation wall, having a notch portion at a part thereof, at a position opposite to the notch portion of the first separation wall and having a larger diameter than the first separation wall, and being formed outside of the first separation wall with a predetermined distance therefrom. The flow passage is communicated with the supply conduit.

Further, the damping portion may be a curved vertical wall formed to the front of a communication hole in the side wall of the filter case at the bottom of the flow-out chamber. The length of the vertical wall is larger than a width of an opening portion of the communication hole, and the vertical wall is formed along the inner wall of the filter case with a predetermined distance therefrom.

Moreover, objects of the invention may be accomplished by combining a plurality of specific pulsation damping portions with various structures as above.

DETAILED DESCRIPTION OF PREFERRED EMBODIMENTS

Figure 1:
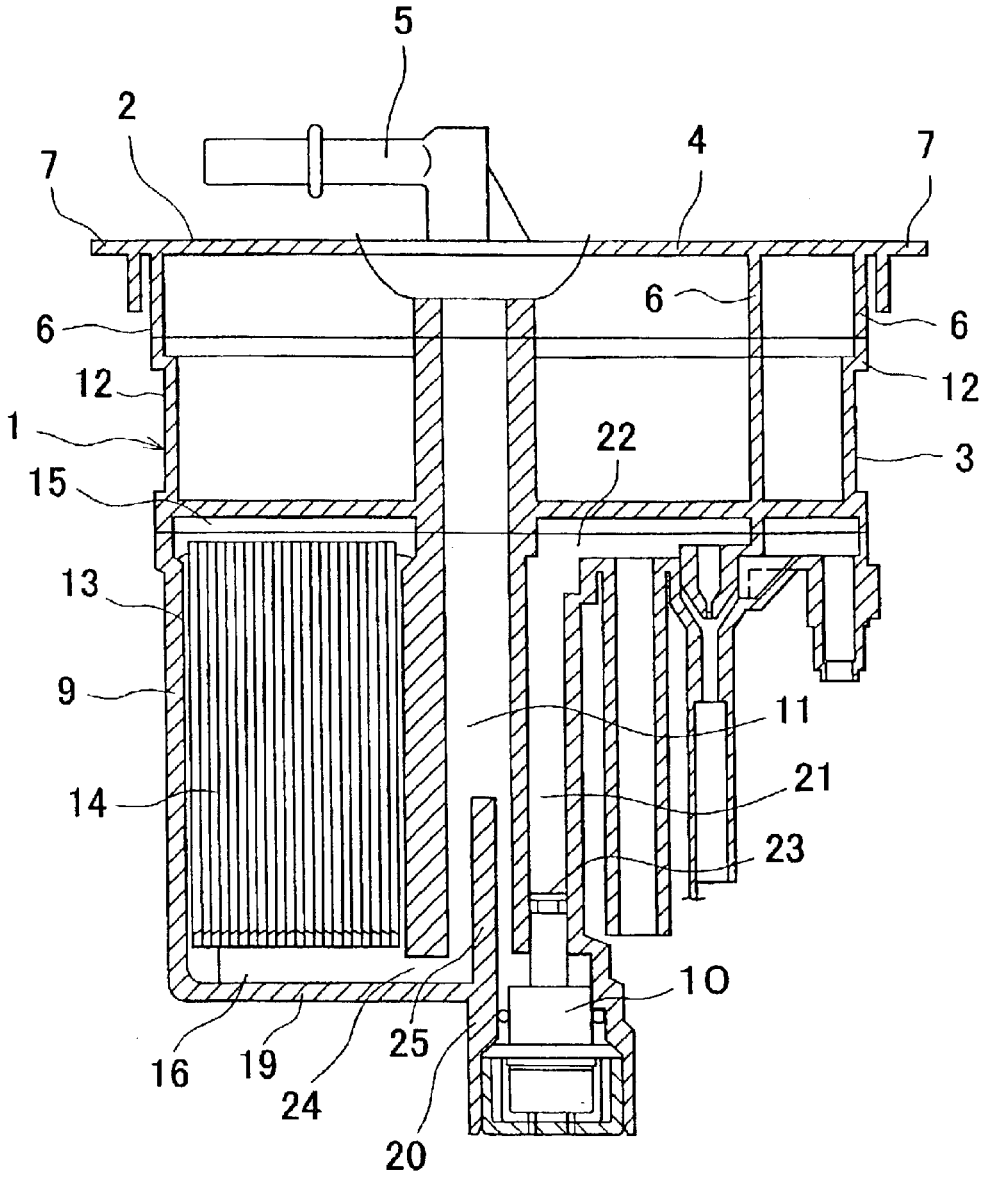
FIG. 1 is a vertical sectional view of a central portion of an entire fuel pump module according to a first embodiment of the invention.

Hereinafter, a pulsation damping portion (ex; pulsation damping means) provided in a fuel pump module will be explained with reference to embodiments.

First, an entire fuel pump module will be explained with reference to FIGS. 1 and 2.

A fuel pump module 1, which is a fuel supply device for an automobile engine or the like, is structured by an upper side member 2 and a lower side member 3. An upper plate portion 4 which serves as a cover member and a supply pipe 5 formed on the upper plate portion 4 are formed at an upper face side of the upper side member 2. Further, a side wall 6 such as a partition wall and a peripheral wall so as to project therefrom is formed at a lower face side of the upper side member 2, and a brim portion 7 is formed at an edge portion of the upper side member 2. Meanwhile, a fuel pump 8, a fuel filter 9, a fuel pressure control valve 10, the supply conduit 11, and a side wall 12 such as a partition wall and a peripheral wall that partitions each of the various parts as above is formed in the lower side member 3.

The fuel pump module 1 which is a unit body is formed by attaching each of the aforementioned parts, and uniting a lower end portion of the side wall 6 of the upper side member 2 to an upper end portion of the side wall 12 of the lower side member 3.

The fuel pump module 1 is installed in a fuel tank, by fixing the brim portion 7 at the edge portion of the upper side member 2 to an attachment hole of the fuel tank.

The fuel pump 8 is a driving source that sucks in a fuel in the fuel tank through the intake side thereof and discharges the fuel that passed through a filter or the like toward an injection port valve at a combustion chamber side. The fuel pressure control valve 10 serves as fuel adjustment means that returns an excess amount of fuel among the discharged fuel into the fuel tank, and maintains a pressure of the fuel supplied from the fuel pump 8 to the injection valve side.

The fuel filter 9 is structured by a filter case 13 and a filter element 14 which is housed in the filter case 13 and formed by cylindrical porous material with many minute pores thereon.

The filter case 13 is formed by a bottomed cylindrical case with an upper side thereof being opened and a lower side being closed. The upper side of the filter case 13 is provided with the upper plate portion 4 which serves as a cover member.

Furthermore, a flow-in chamber 15 and a flow-out chamber 16 are formed in spaces above and below the filter element 14 of the filter case 13, respectively.

A connecting tubular portion 18, on which a discharge pipe 17 of the fuel pump 8 is formed, is integrally provided at the upper portion side of the filter case 13 of the fuel filter 9. The connecting tubular portion 18 connects the discharge pipe 17 of the fuel pump 8 with the flow-in chamber 15 of the fuel filter 9. Therefore, the fuel discharged to the flow-in chamber 15 side by delivery force of the fuel pump 8, is filtered by the filter element 14 while passing through it, and flows out to the flow-out chamber 16.

The supply conduit 11 is formed on the outer periphery of the filter case 13 so as to extend in the vertical direction and supplies the fuel to an engine combustion chamber. The supply conduit 11 is a passage for a fuel which flows out from the flow-out chamber 16 of the fuel filter 9 and the fuel pressure control valve 10. It is continuously formed with the supply pipe 5.

Therefore, the fuel discharged from the discharge pipe 17 of the fuel pump 8 is supplied to the combustion chamber via the fuel filter 9, the supply conduit 11, the supply pipe 5, and the like, and some of the fuel is returned into the fuel tank by the fuel pressure control valve 10.

The fuel pressure control valve 10 is attached to the fuel pump module 1 via a tubular attachment portion 20 for the fuel pressure control valve 10 formed at the bottom portion 19 of the filter case 13. The attachment portion 20 for the fuel pressure control valve 10 is a short tubular body formed at the bottom portion of the filter case 13, and the inner peripheral side thereof is communicated with the flow-out chamber 16 of the fuel filter 9.

A return conduit 21 is provided extending in the vertical direction on the outer peripheral side of the filter case. An upper portion side of the return conduit 21 is communicated with the return passage 22, and an lower portion side thereof is opened to the center of the attachment portion 20 for the fuel pressure control valve 10. In addition, the return conduit 21 guides a fuel (return fuel) flowing out of a return port 23 of the fuel pressure control valve 10, among the fuel discharged from the fuel pump 8.

In the aforementioned fuel pump module 1, the fuel is applied with pulsation from the fuel pump 8, which is a driving source, by means of rotation of the motor for delivering the fuel. Next, the fuel, with being applied with pulsation, is delivered to the supply conduit 11 and the fuel pressure control valve 10.

Further, the aforementioned pulsation is amplified by the filter element 14 in the filter case 13. Thus, larger pulsation is applied to the fuel and transmitted to the fuel pressure control valve 10. In the fuel pressure control valve 10, pulsation is further amplified because the fuel pressure control valve 10 further acts as a resonant body. This pulsation of the fuel generates an abnormal noise such as a valve hit noise from the fuel pressure control valve 10.

Figure 2:
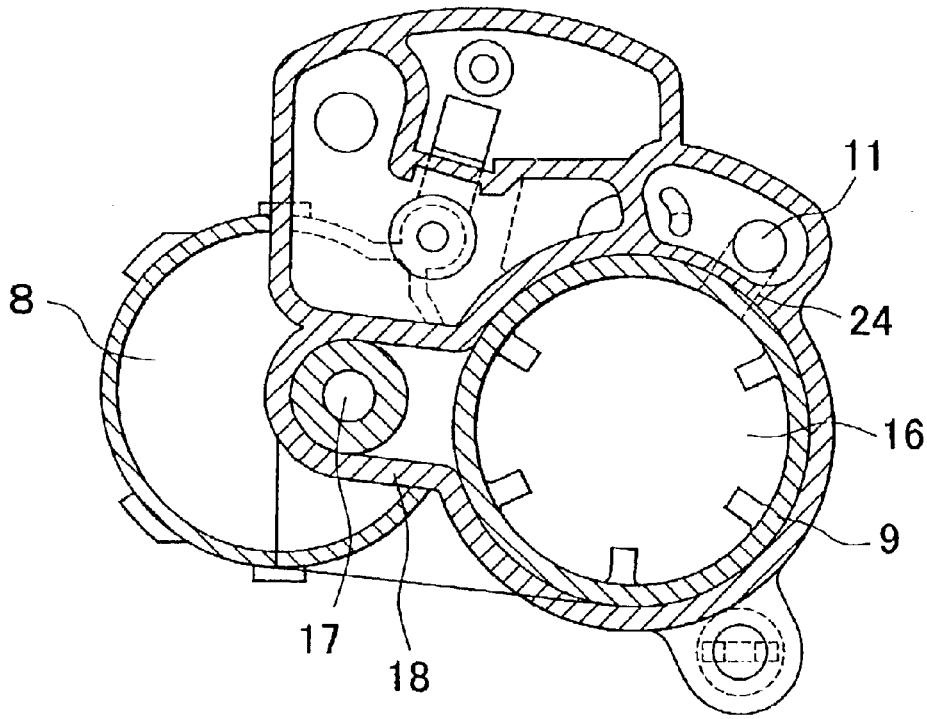
FIG. 2 is a horizontal sectional view of the entire fuel pump module according to the invention.

As shown in FIGS. 1 and 2, a pulsation damping portion (ex; pulsation damping means) is formed in the supply conduit 11, as a first embodiment of pulsation damping means (a damping portion) of a pulsation damping device in the fuel pump module 1.

The supply conduit 11 is formed on an outer periphery of the filter case 13 so as to extend in the vertical direction and supplies the fuel. It communicates the flow-out chamber 16 with the supply pipe 5.

The flow-out chamber 16 at the bottom portion 19 of the filter case 13 is continuously formed with the supply conduit 11 through a communication hole 24 formed in the side wall of the filter case 13. A buffer wall 25 is provided vertically in the supply conduit 11 at a position corresponding to the attachment portion 20 for the fuel pressure control valve 10.

The buffer wall 25 is provided vertically so as to divide an inside of the supply conduit 11 and have a predetermined height, forming a branch passages. One of the branch passages is communicated with a supply pipe connecting to the combustion chamber, and the other is communicated with the fuel pressure control valve 10. In addition, a space surrounded by the buffer wall 25 and the outer peripheral wall of the filter case 13 and a space surrounded by the buffer wall 25 and a wall of the return conduit 21 form a pipe-shaped communication space.

The fuel, that passed the filter element 14 and flowed to the flow-out chamber 16, passes through the communication hole 24, collides with the buffer wall 25, and passes through a narrow space surround by the buffer wall 25. Subsequently, the branch passages allow some of the fuel to be discharged through the supply conduit 11 to the supply pipe 5 and the other to flow out to the fuel pressure control valve 10.

The pipe-shaped space formed by the buffer wall 25 reduces pulsation of the fuel that was discharged to the supply conduit 11 or flowed out to the fuel pressure control valve 10. Thus generation of an abnormal noise such as a valve hit noise caused by the fuel that flowed out to the fuel pressure control valve 10 is inhibited.

Since the pipe-shaped communication space is formed by the aforementioned buffer wall 25, fluid friction is generated in the fuel by an inner wall in the space, causing friction loss in pulsation of the fuel. Moreover, the fuel moves from the flow-out chamber 16 with a relatively large capacity at the bottom portion 19 of the filter case 13 to the narrow space surrounded by the buffer wall 25, and thus there is a loss in pulsation of the fuel due to a change of a conduit shape which is suddenly becomes narrow.

Moreover, in the first embodiment, the conduit is bent at substantial right angles from the flow-out chamber 16, it is possible to adopt a similar loss coefficient such as an elbow and a bend, providing loss to pulsation of the fuel.

Further, since the buffer wall 25 is provided vertically so as to divide the inside of the supply conduit 11 and have a predetermined height, a distance between the flow-out chamber 16 and the fuel pressure control valve from which an abnormal noise such as a valve hit noise is generated becomes longer by that height. Therefore, pulsation of the fuel is damped.

Figure 3:
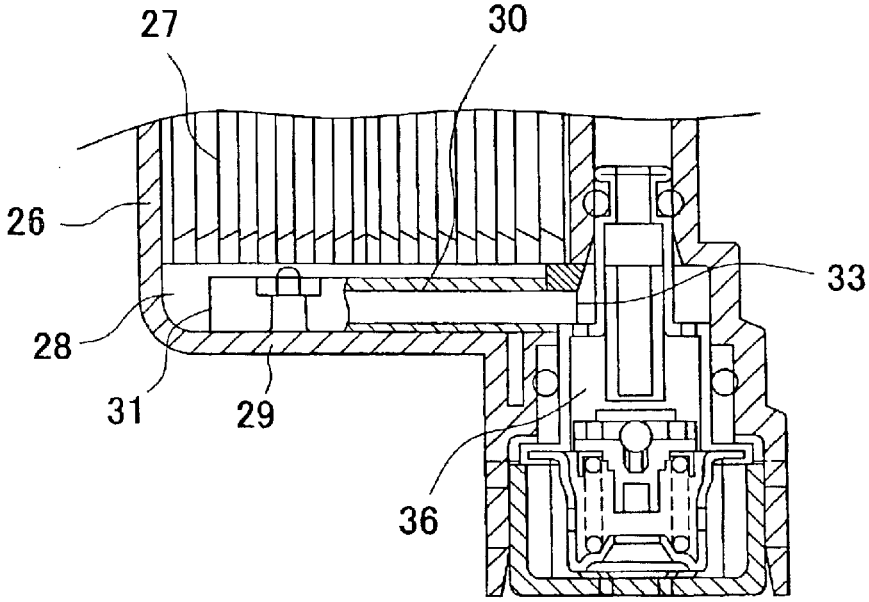
FIG. 3 is a vertical sectional view of a central portion of a part of a pulsation damping device in a fuel pump module according to a second embodiment of the invention.
Figure 4:
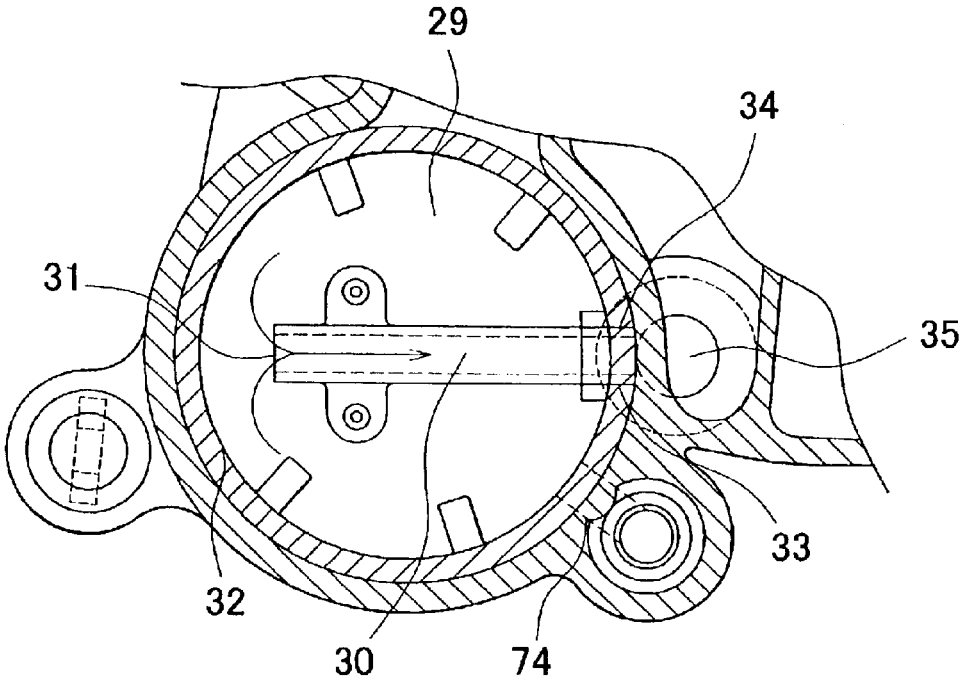
FIG. 4 is a horizontal sectional view of the pulsation damping device in a fuel pump module according to the second embodiment of the invention.

FIGS. 3 and 4 show a second embodiment of a pulsation damping portion (ex; pulsation damping means) in a fuel pump module.

A conduit 30 is formed at a bottom portion 29 of a flow-out chamber 28 formed below a filter element 27 of a filter case 26.

The conduit 30 can be fixed to the bottom portion 29 by U-shaped engagement attachment means, fusion melting, or the like. Further, both ends of the conduit 30 are opened. One end portion 31 of the conduit 30 is disposed inside of an inner wall 32 of the filter case 26 with a slight distance therefrom, and the other end portion 33 is opened to a return conduit 35 and a fuel pressure control valve 36 side through a communication hole 34 formed in the inner wall.

The fuel that passed through the filter element 27 and flowed out to the flow-out chamber 28 is discharged to the supply pipe 5 through a communication hole 74. Some of the fuel flows in through an opening at the one end portion 31 of the conduit 30, passes the conduit 30, and flows out to the fuel pressure control valve 36 through an opening at the other end portion 33 side.

In this case, the fuel that flows out to the return conduit 35 and the fuel pressure control valve 36 always passes through the conduit 30. By passing through the conduit 30, the fuel collides with the inner wall in the conduit. Therefore, the conduit 30 reduces pulsation of the fuel that flows out to the return conduit 35 and the fuel pressure control valve 36 side. Accordingly, generation of an abnormal noise such as a valve hit noise caused by the fuel that flowed out to the fuel pressure control valve 36 is inhibited.

The aforementioned conduit 30 forms a communicated but closed space in the pipe, and fluid friction is generated in the fuel by the inner wall in the space, causing friction loss in pulsation of the fuel. Moreover, since the fuel moves from the flow-out chamber 28 with a relatively large capacity at the bottom portion 29 of the filter case 26 to the conduit 30 with a smaller capacity than the flow-out chamber 28. Accordingly, the loss is caused in pulsation of the fuel, due to a sudden change of the conduit shape.

Figure 5:
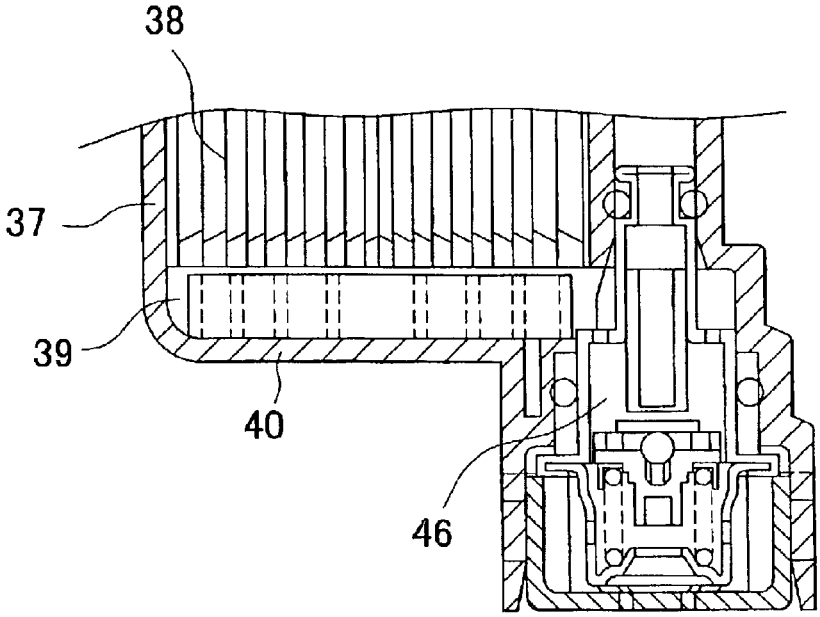
FIG. 5 is a central portion of a part of a pulsation damping device in a fuel pump module according to a third embodiment of the present invention.
Figure 6:
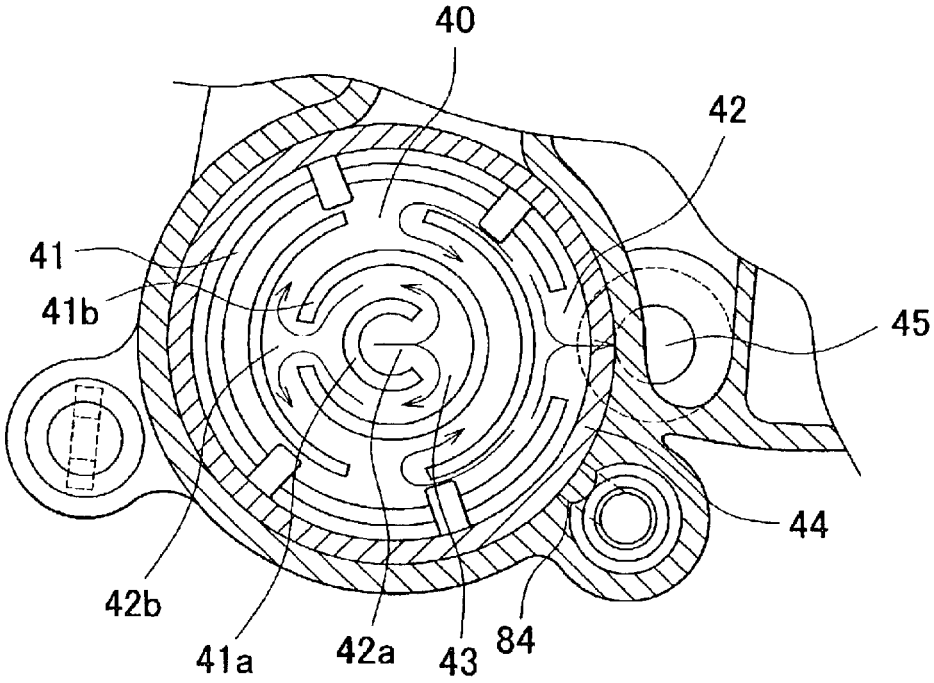
FIG. 6 is a horizontal sectional view of the pulsation damping device in a fuel pump module according to the third embodiment of the invention.

FIGS. 5 and 6 show a third embodiment of a pulsation damping portion (ex; damping means) in a fuel pump module.

Separation walls 41, 41*a* and 41*b* are formed at a bottom portion 40 of a flow-out chamber 39 formed below a filter element 38 of a filter case 37. The separation walls 41, 41*a* and 41*b* forms a labyrinthine flue flow passage.

The separation walls 41, 41*a* and 41*b* may, in advance, be vertically provided on an upper portion of a plate-like body with a shape fitting to an inner dimension of the bottom portion 40. It is possible to attach the plate-like body by means of fitting-in, engagement attachment or the like, or to fix it by fusion melting or the like. The separation walls 41, 41*a* and 41*b* may also be integrally formed when the filter case 37 is formed.

The separation wall 41*a* has a small circular sharp and is formed at a central portion thereof, and a part thereof forms a notch portion 42*a*. Furthermore, a slightly larger circular separation wall 41*b* is formed surrounding the outer periphery of the separation wall 41*a* with a predetermined distance therefrom. A part of the separation wall 41*b* forms a notch portion 42*b* at a position which is opposite in direction to the notch portion 42*a*. By repeatedly disposing the separation wall 41, several rings are formed in which the notch portions 42*a*, 42*b*. . . are formed at positions opposite to the notch portions in the adjacent separation wall 41, centering around the separation wall 41*a*. Thus, the labyrinthine fuel flow passage 43 is formed between the separation walls 41*a*, 41*b* . . . .

Furthermore, a notch portion 42*x* of a separation wall 41*x* at the outermost peripheral portion is opened to a return conduit 45 and a fuel pressure control valve 46 side through a communication hole 44 formed in the side wall of the filter case 37.

The fuel that passed through the filter element 38 and flowed out to the flow-out chamber 39, flows into the fuel flow passage 43. Then it passes through the flow passage 43, and some of the fuel discharged to the supply pipe 5 through a communication hole 84, while other flows out to the fuel pressure control valve 46 through the communication hole 44.

The fuel that flowed out to the return conduit 45 and the fuel pressure control valve 46 always passes through the flow passage 43, and the fuel collides with the separation walls 41, 41*a* and 41*b* by passing through the flow passage 43. Therefore, the flow passage 43 in a space created by the separation walls 41, 41*a* and 41*b* reduces pulsation of the fuel that flowed out to the fuel pressure control valve 46 side. Further, generation of an abnormal noise such as a valve hit noise caused by the fuel that flowed out to the fuel pressure control valve 46 is inhibited The aforementioned separation walls 41, 41*a* and 41*b* create the communicated flow passage 43. Since the fuel passes through the flow passage 43, fluid friction is generated in the fuel by a wall surface of the separation walls 41, 41*a* and 41*b* causing friction loss in pulsation of the fuel. Moreover, the separation walls 41, 41*a* and 41*b* form the fuel passage in a curved manner, it is possible to adopt a similar loss coefficient such as an elbow and a bend, providing loss to pulsation of the fuel.

Figure 7:
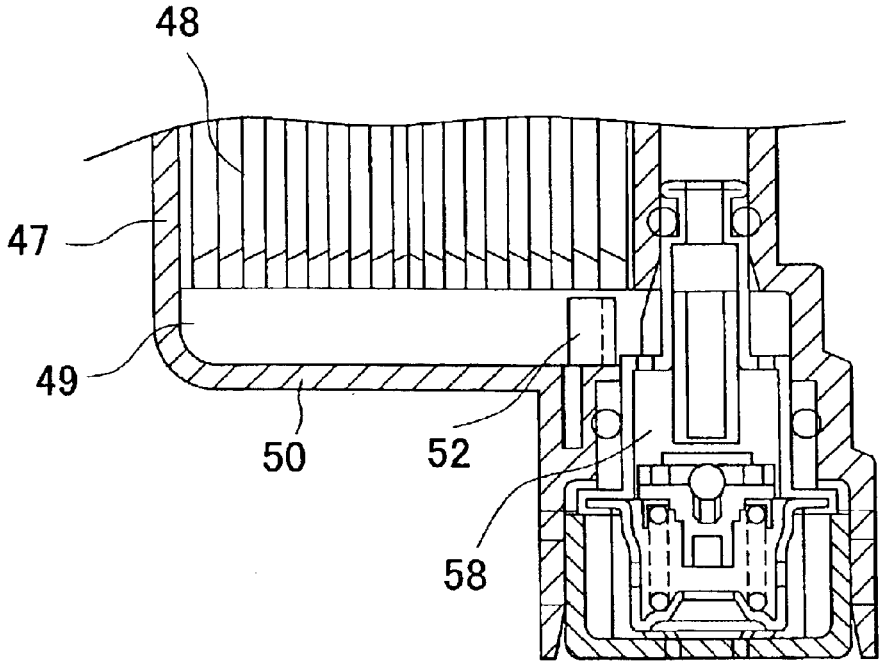
FIG. 7 is a vertical sectional view of a central portion of a part of a pulsation damping device in a fuel pump module according to a fourth embodiment of the invention.
Figure 8:
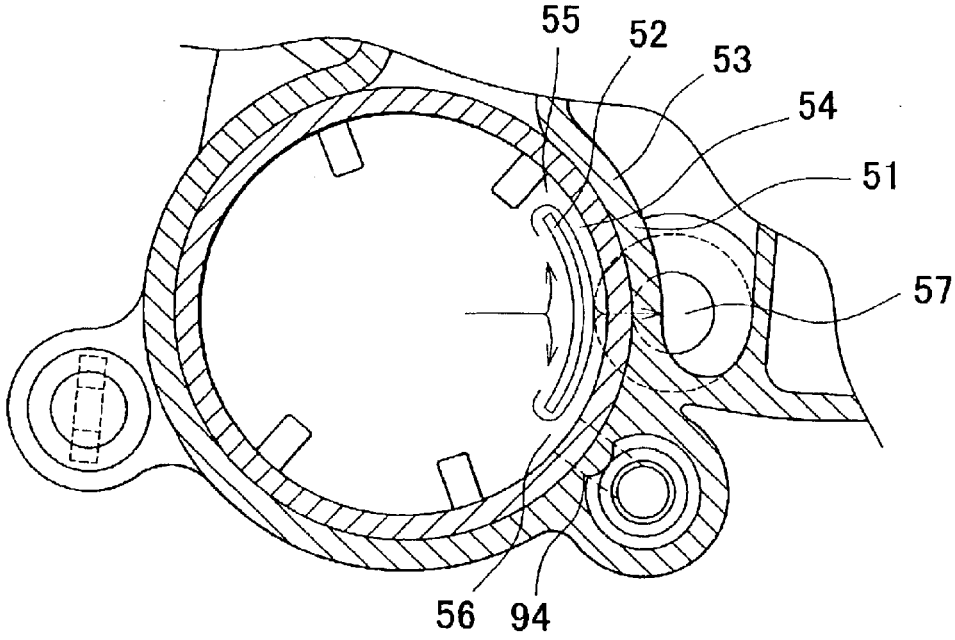
FIG. 8 is a horizontal sectional view of the pulsation damping device in a fuel pump module according to the fourth embodiment of the invention.
Figure 9:
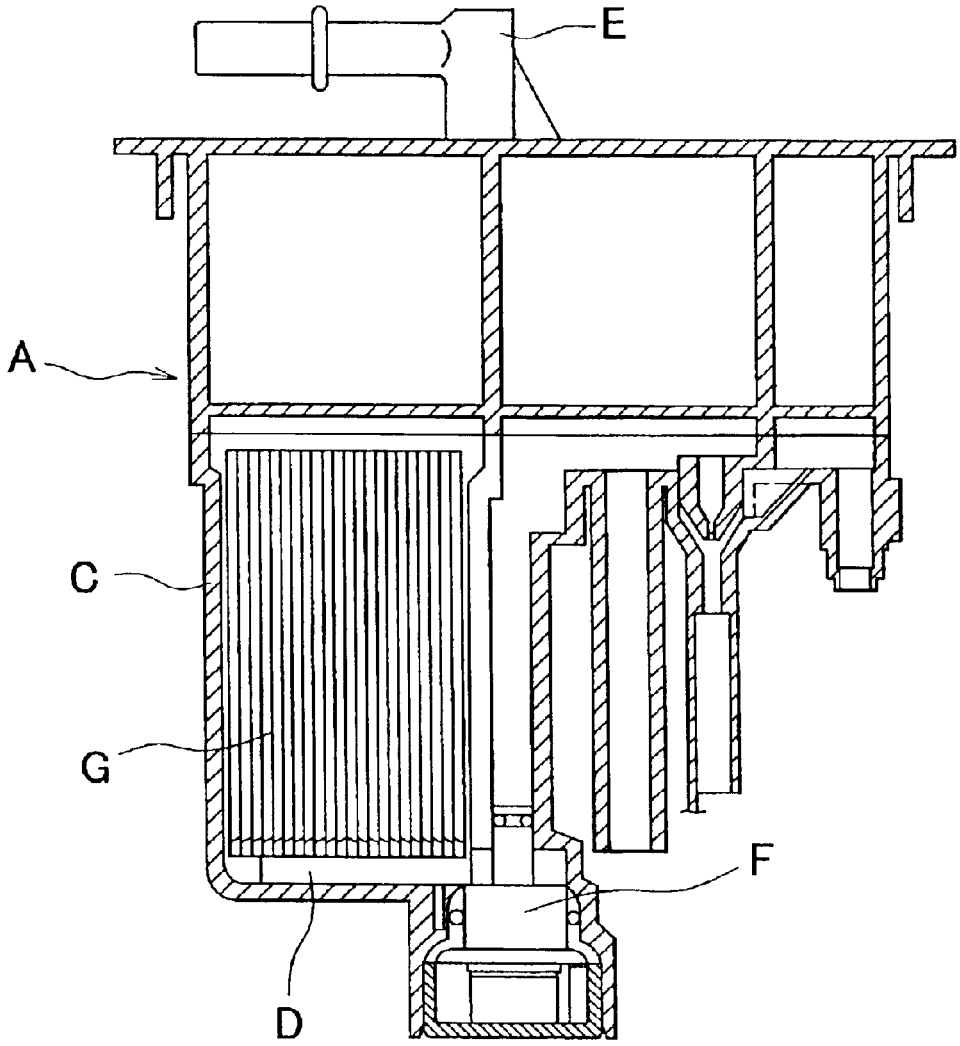
FIG. 9 RELATED ART
FIG. 9 is a vertical sectional view of a central portion of an entire fuel pump module which is a related art of the invention.
Figure 10:
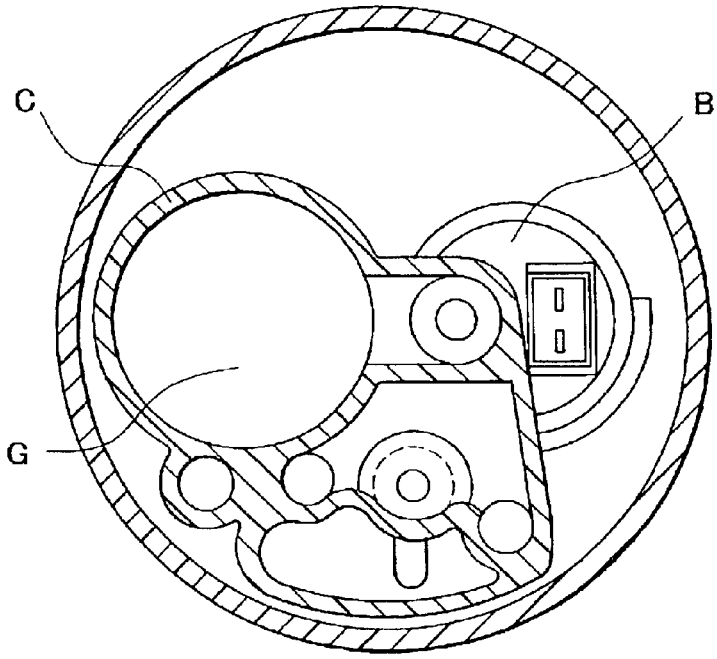
FIG. 10 RELATED ART
FIG. 10 is a horizontal sectional view of the fuel pump module which is a related art of the invention.

FIGS. 7 and 8 show a pulsation damping portion (ex; damping means) in a fuel pump module according to a fourth embodiment.

A vertical wall 52 is formed to the front of a communication hole 51 formed in the side wall of a filter case 47 at a bottom portion 50 of a flow-out chamber 49 formed below the filter element 48 of the filter case 47.

The vertical wall 52 may be formed by attaching, in advance, a plate-like body constituting the vertical wall 52 by means of fitting-in and engagement attachment, or fixing it by means of fusion melting or the like. Alternatively, the vertical wall 52 may be integrally formed when the filter case 47 is formed.

The vertical wall 52 is formed separately from and along an inner wall 53 of the filter case 47 with a predetermined interval portion 54 therebetween. It is formed as a curved separation wall to the front side of a communication hole 51. The vertical wall 52 is formed larger than an opening portion of the communication hole 51, and a fuel flow passage constituted by the interval portion 54 with a predetermined width is created.

The fuel that passed through the filter element 48 and flowed out to the flow-out chamber 49 collides with the vertical wall 52 formed to the front of the communication hole 51. Thus collided fuel, is discharged to the supply pipe 5 through a communication hole 94. Some of the fuel is branched to left or right along the vertical wall 52 and flows in through flow-in ports 55, 56 at the end portion of the vertical wall 52, which serves as an inlet to the interval portion 54. Next, the fuel passes through the interval portion 54, and flows out to a fuel pressure control valve 58 through the communication hole 51.

The fuel collides with the vertical wall 52, and passes through the flow passage in the interval portion 54. After that, the fuel flows out to the return conduit 57 and the fuel pressure control valve 58. Pulsation of the fuel that flowed out to the return conduit 57 and the fuel pressure control valve 58 side is reduced because of its collision with the vertical wall 52 and passing through the flow passage in the interval portion 54. Moreover, generation of an abnormal noise such as a valve hit noise caused by the fuel flowing out to the fuel pressure control valve 58 is inhibited.

Since the vertical wall 52 forms a curved separation wall along the inner wall 53 of the filter case 47, the vertical wall 52 changes a direction in which the fuel flows out causing a loss in pulsation of the fuel. Moreover, the fuel flows in from the flow-out chamber 49 with a relatively large capacity at the bottom portion 50 of the filter case 47 to the interval portion 54 through the flow-in ports 55, 56, and sudden change of the passage causes loss in pulsation of the fuel.

In each of the embodiments 1 to 4, an example is shown of in which only one pulsation damping means is used. It is possible, however, to form a pulsation damping device by combining a plurality of the pulsation damping means according to the embodiments 1 to 4.

In a fuel pump module in a fuel tank with a structure above according to the invention, a pulsation damping portion (ex; pulsation damping means) is structured in a passage between a flow-out chamber formed below a filter element in a fuel filter and a fuel pressure control valve which is an adjacent portion to the flow-out chamber generates an abnormal noise such as a valve hit noise. Accordingly, generation of an abnormal noise such as a valve hit noise from the fuel pressure control valve can be inhibited.

Pulsation which is applied to the fuel by rotation of the motor of the fuel pump and amplified generates an abnormal noise such as a valve hit noise. However, the cause of generation of an abnormal noise such as a valve hit noise can be eliminated by suppressing pulsation by giving loss to pulsation energy of the fuel by employing means for reducing pulsation at the flow-out chamber and/or the adjacent portion to the flow-out chamber. This means includes extending a passage in which the fuel flows out, narrowing the passage, providing buffer means to reduce the impact energy thereof, and changing the direction in which the fuel flows, or the like.

What is claimed is:

1. A fuel pump module comprising:

a fuel pump that sucks and discharges a fuel in a fuel tank, a fuel filter disposed downstream of the fuel pump, that removes a foreign matter in the fuel, a fuel pressure control valve that adjusts a pressure of the fuel flowing out from the fuel filter, the fuel having the adjusted pressure is discharged from the fuel pump module, and a damping portion, disposed between the fuel filter and the fuel pressure control valve, that damps pulsation of the fuel.

2. An apparatus according to claim 1, wherein the fuel filter is provided with a filter case for housing a filter element, outside the filter case, a supply conduit is disposed which is communicated with the fuel pressure control valve, and in the filter case, a flow-out chamber formed downstream of the filter element is formed, and the flow-out chamber is communicated with the supply conduit via a communication hole formed in a side wall of the filter case.

3. An apparatus according to claim 2, wherein the supply conduit is communicated with a supply pipe to a combustion chamber of an internal combustion engine.

4. An apparatus according to claim 2, wherein the damping portion is a buffer wall formed in the supply conduit such that the fuel that flows out from the flow-out chamber collide with the buffer wall, and the direction in which the fuel flows is changed by collision with the buffer wall, and subsequently the fuel flows to the fuel pressure control valve.

5. An apparatus according to claim 4, wherein the supply conduit is communicated with the supply pipe to the combustion chamber of the internal combustion engine, which is disposed outside the pump module, and the fuel, after colliding with the buffer wall, flows into the fuel pressure control valve and the supply pipe.

6. An apparatus according to claim 2, wherein the damping portion is a conduit disposed in the flow-out chamber, and one end portion of the conduit is opened in the flow-out chamber, and other end portion is opened in the supply conduit.

7. An apparatus according to claim 2, wherein the damping portion is a flow passage disposed in the flow-out chamber, the flow passage is a fuel flow passage formed by a first circular separation wall having a notch portion at a part thereof for dividing a substantially circular space, and a second separation wall having a notch portion at a part thereof at a position opposite to the notch portion of the first separation wall and having a larger diameter than the first separation wall, and is formed outside of the first separation wall with a predetermined distance, and the flow passage is communicated with the supply conduit.

8. An apparatus according to claim 2, wherein the damping portion is a wall formed in the flow-out chamber, and the wall is formed to the front of the communication hole having a larger length than a width of the communication hole, and along an inner wall of the filter case with a predetermined distance from the inner wall.

9. An apparatus according to claim 2, wherein the damping portion is a passage communicating the flow-out chamber with the supply conduit, and the passage is longer than the communication hole formed in the side wall of the filter case.

10. An apparatus according to claim 2, wherein the damping portion is a passage communicating the flow-out chamber with the supply conduit, and the passage has a smaller cross sectional area than the flow-out chamber.

* * * * *

UNITED STATES PATENT AND TRADEMARK OFFICE

CERTIFICATE OF CORRECTION

PATENT NO. : 6,789,529 B2 
DATED : September 14, 2004
INVENTOR(S) : Masakazu Suzuki, Yasuhiro Hosoya and Hironobu Oki It is certified that error appears in the above-identified patent and that said Letters Patent is hereby corrected as shown below:

Title page,
Item [73], Assignee, "Kyosan Denki Co., Ltd., Ibaraki (JP)" should read -- Kyosan Denki Co., Ltd., Ibaraki (JP); Hitachi Unisia Automotive, Limited, Atsugi-shi (JP) --

Signed and Sealed this

Twenty-second Day of February, 2005

JON W. DUDAS
*Director of the United States Patent and Trademark Office*